US006695022B2

(12) United States Patent
Morehead

(10) Patent No.: US 6,695,022 B2
(45) Date of Patent: Feb. 24, 2004

(54) TETHERED WALLET

(76) Inventor: William Morehead, 2600-3 Cleinview Ave., Cincinnati, OH (US) 45206

( * ) Notice: Subject to any disclaimer, the term of this patent is extended or adjusted under 35 U.S.C. 154(b) by 0 days.

(21) Appl. No.: 10/268,128

(22) Filed: Oct. 10, 2002

(65) Prior Publication Data

US 2003/0150536 A1 Aug. 14, 2003

Related U.S. Application Data

(60) Provisional application No. 60/356,219, filed on Feb. 12, 2002.

(51) Int. Cl.[7] ..... A45C 1/06; A45C 11/32; A45C 13/30

(52) U.S. Cl. ..... 150/134; 150/102; 150/152; 224/603; 224/901.4

(58) Field of Search ..... 150/133, 134, 150/102, 152; D3/227, 247; 224/587, 603, 901.4

(56) References Cited

U.S. PATENT DOCUMENTS

| | | | | | |
|---|---|---|---|---|---|
| 1,298,278 | A | | 3/1919 | Bashinski | |
| 1,816,284 | A | * | 7/1931 | Hughes | 150/134 |
| 2,908,306 | A | * | 10/1959 | Chorost | 150/134 |
| 3,648,906 | A | * | 3/1972 | Ross | 224/605 |
| D229,792 | S | * | 1/1974 | Vitol | D3/227 |
| 3,813,017 | A | * | 5/1974 | Pimsleur | 224/26 R |
| 4,139,914 | A | * | 2/1979 | Tarr | 2/247 |
| 4,174,793 | A | * | 11/1979 | Wisowaty | 224/240 |
| 4,303,187 | A | * | 12/1981 | Berman | 224/222 |
| 4,356,943 | A | * | 11/1982 | Berman | 224/222 |
| 4,570,688 | A | | 2/1986 | Williams | 150/134 |
| 4,815,510 | A | * | 3/1989 | Edelist | 150/134 |
| 4,905,881 | A | | 3/1990 | Graber | 224/222 |
| D321,595 | S | * | 11/1991 | Costello | D3/226 |
| 5,215,237 | A | * | 6/1993 | Wu | 224/230 |
| 5,366,072 | A | * | 11/1994 | Goldenberg | 224/205 X |
| 5,497,818 | A | | 3/1996 | Marcarelli | 150/134 |
| 5,551,496 | A | * | 9/1996 | Gray, Jr. | 150/134 |
| 5,611,470 | A | * | 3/1997 | Vias et al. | 224/240 |
| 5,622,301 | A | * | 4/1997 | Blum | 224/587 |
| 5,893,496 | A | * | 4/1999 | Katz et al. | 224/181 |
| 6,026,515 | A | * | 2/2000 | Nielson et al. | 150/134 X |
| 6,182,878 | B1 | * | 2/2001 | Racca | 224/605 |

FOREIGN PATENT DOCUMENTS

| | | | | |
|---|---|---|---|---|
| GB | 2238826 | * | 12/1991 | 150/134 |

* cited by examiner

*Primary Examiner*—Sue A. Weaver
(74) *Attorney, Agent, or Firm*—Howard & Howard

(57) ABSTRACT

A wallet (10) includes a pocket portion (12) defining a front panel (14), a rear panel (16), a bottom (18), side edges (20), (22), an open top (24), and a flap portion (26) that extends from the rear panel (16) for folding over the open top (24) to engage the front panel (14). The wallet (10) comprises male and female fasteners for engaging the flap portion (26) with the front panel (14). The wallet (10) includes a tether (32) that extends from the rear panel (16) of the pocket portion (12). The tether (32) includes a plurality of fasteners (34), (36), (38) spaced from one another for folding the tether (32) upon itself to define loops of different sizes, i.e. different configurations for various attachments.

1 Claim, 4 Drawing Sheets

FIG - 5
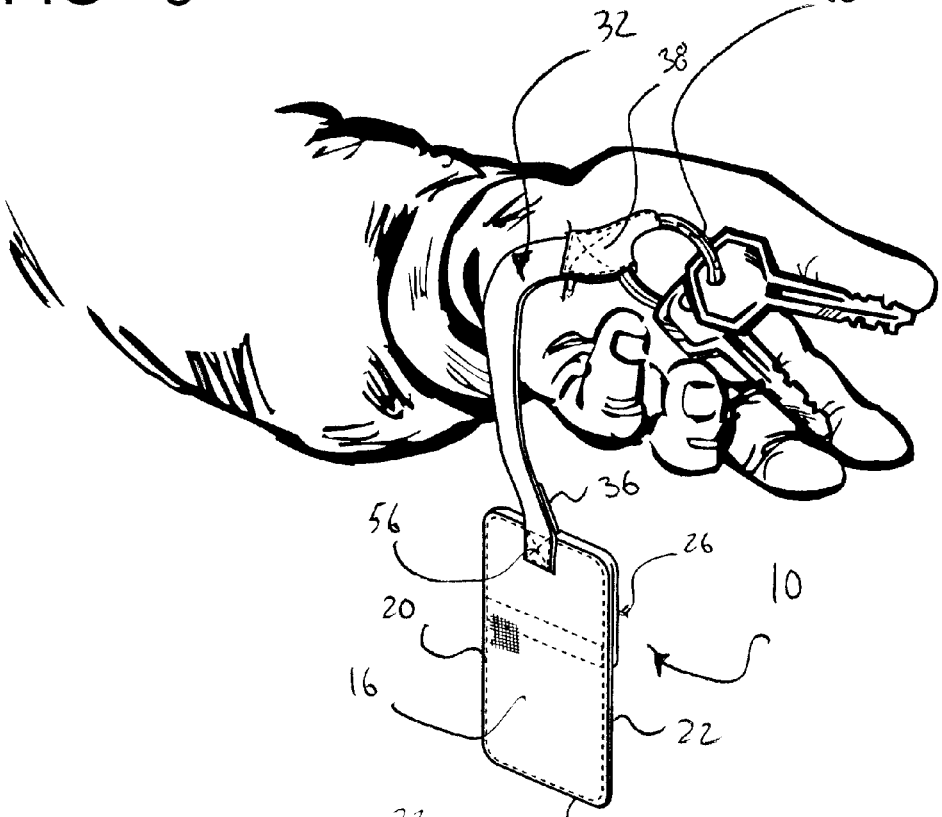
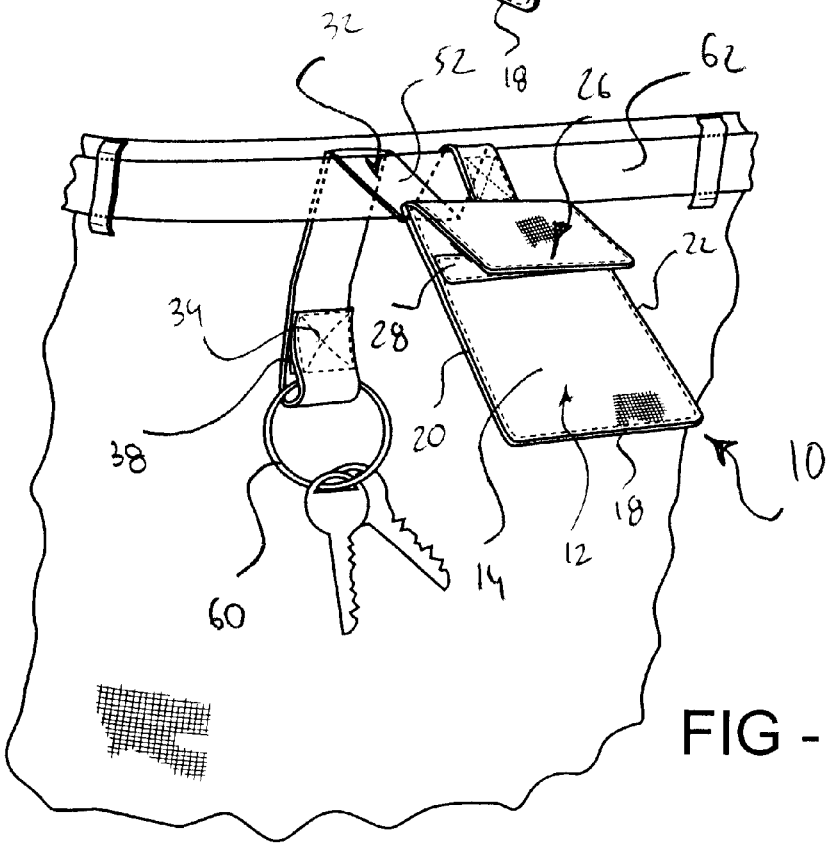
FIG - 6

FIG - 7
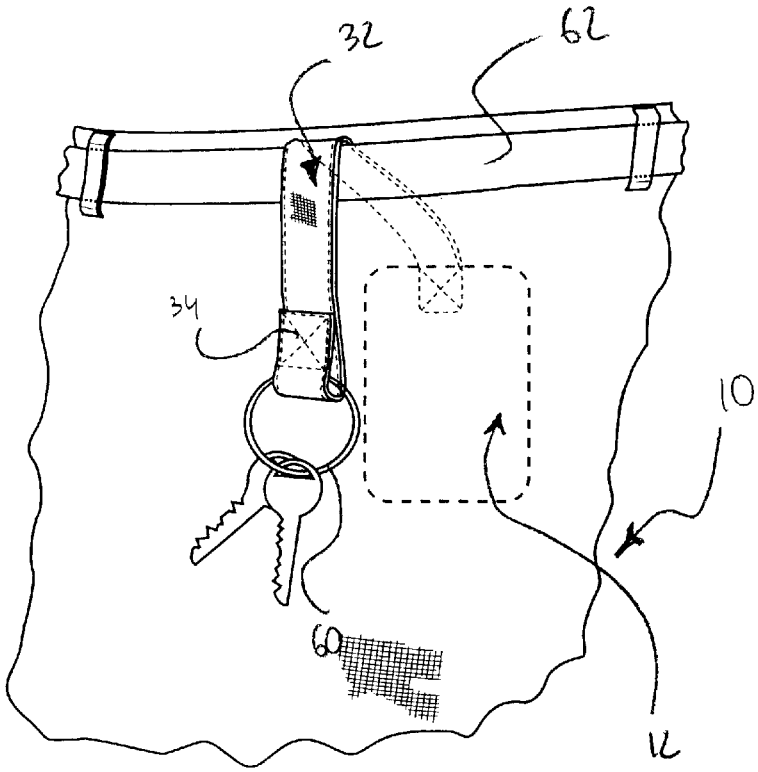
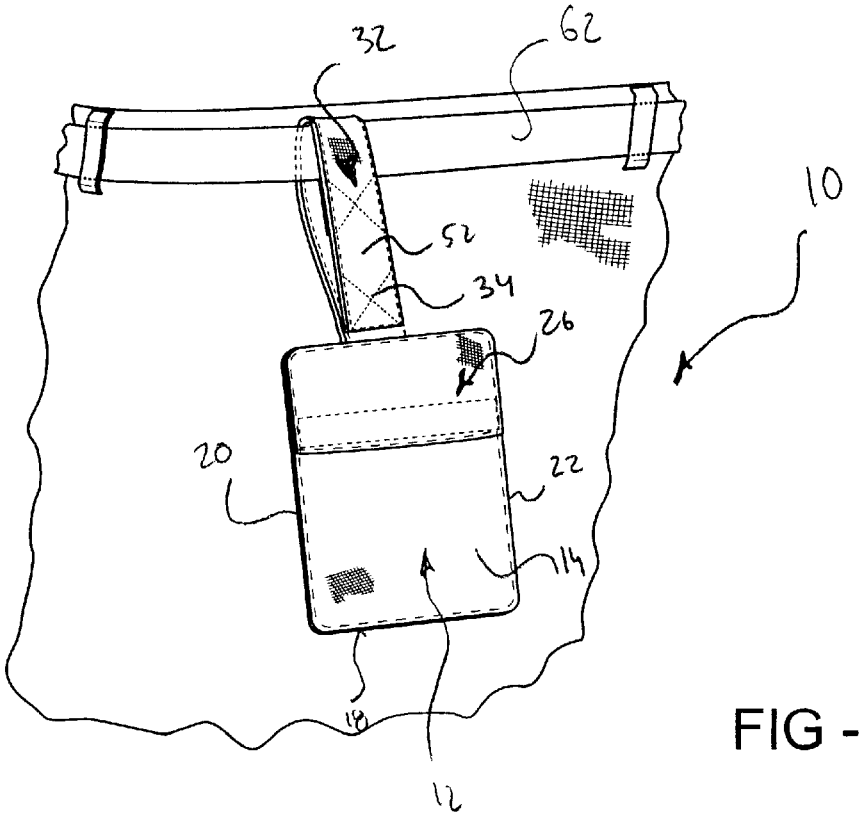
FIG - 8

TETHERED WALLET

RELATED APPLICATION

This application claims priority from the now abandoned provisional application Ser. No. 60/356,219, filed Feb. 12, 2002.

BACKGROUND OF THE INVENTION

1. Field of the Invention

The subject invention relates to wallets, or the like, and more particularly to a tethered wallet.

2. Description of the Prior Art

Numerous wallets to be attached to the body or clothing are known in the prior art as illustrated in U.S. Pat. Nos. 4,905,881 issued to Graber; 4,570,688 issued to Williams; 5,497,818 issued to Marcarelli; and 1,298,278 issued to Bashinski.

Although the prior art patents show variety of wallets, each wallet has one configuration to attach the wallet to the body or clothing. There remains a need for a wallet that may be attached or tethered to the body or clothing in a variety of configurations.

BRIEF SUMMARY OF INVENTION

A wallet comprises a pocket portion defining a pocket having a front panel, a rear panel, a bottom, side edges and an open top, wherein the front and rear panels are being sandwiched and secured together along said edges thereof. The wallet further includes a flap portion that extends from the rear panel for folding over the open top to engage the front panel. The wallet includes a plurality of fasteners disposed on the front panel and flap portion for engaging the flap portion with the front panel. The wallet includes a tether extending from the rear panel of the pocket portion and includes a plurality of fasteners, spaced from one another, for folding the tether upon itself to define a loop of various different sizes.

Accordingly, the tethered wallet of the present invention has a variety of configurations to be worn over the belt, inside or outside the waistband, or attached to a key-ring.

BRIEF DESCRIPTION OF THE DRAWINGS

Other advantages of the present invention will be readily appreciated as the same becomes better understood by reference to the following detailed description when considered in connection with the accompanying drawings wherein:

FIG. 5 is another perspective view of the tethered wallet;

FIG. 6 is a perspective view of the tethered wallet attached to a key-ring wherein the wallet is loop strapped several times around the belt;

FIG. 7 is a is a perspective view of the tethered wallet attached to the key-ring wherein the wallet located inside the waistband; and FIG. 8 is a perspective view of the tethered wallet attached to the belt.

DETAILED DESCRIPTION OF THE INVENTION

Figure 1:
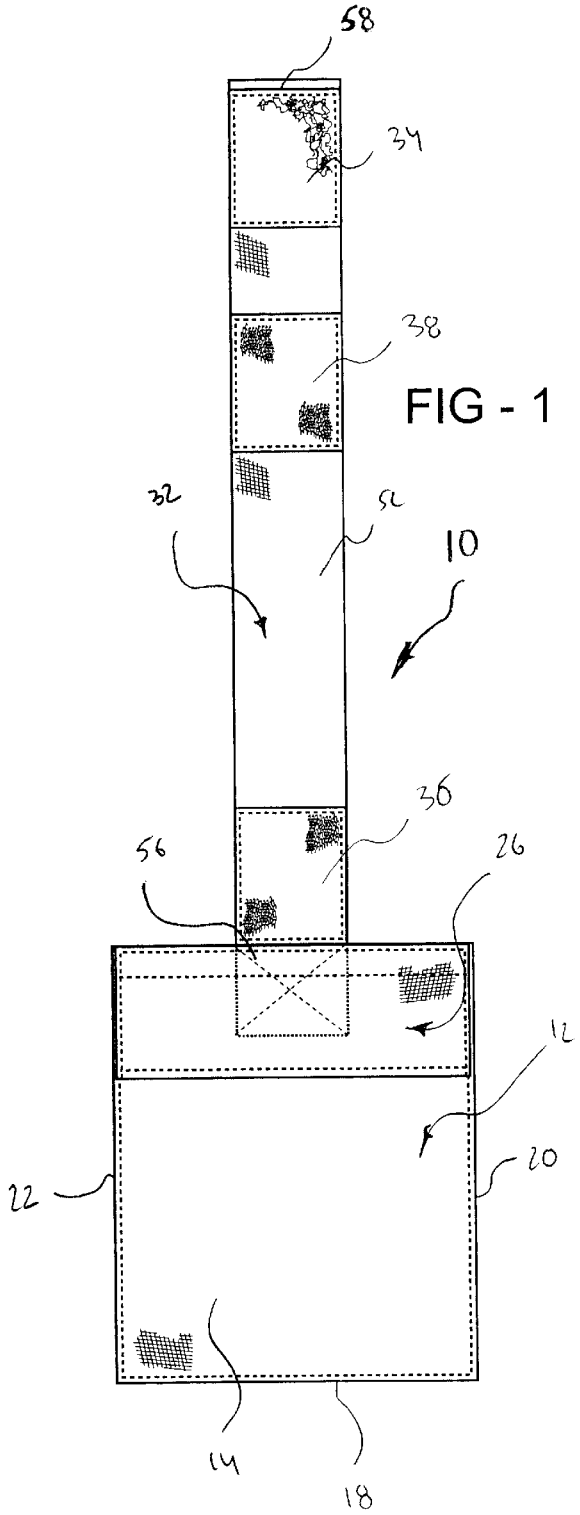
FIG. 1 is a front view of a tethered wallet.
Figure 2:
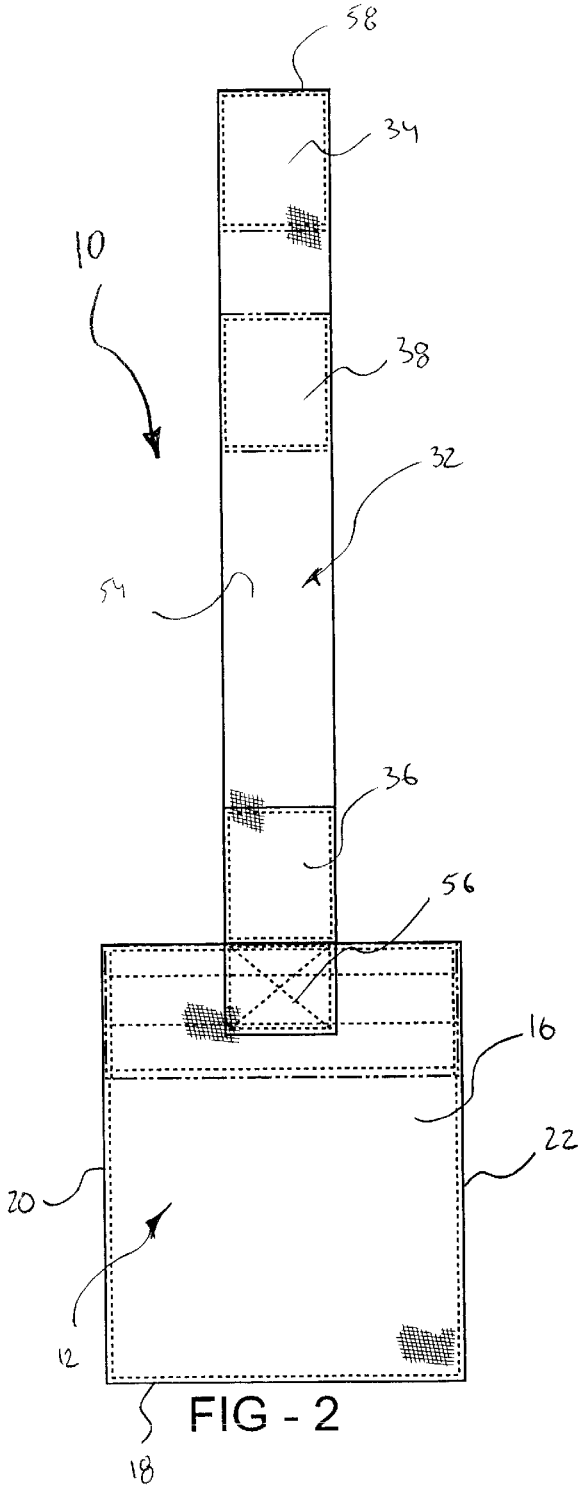
FIG. 2 is a rear view of the tethered wallet
Figure 3:
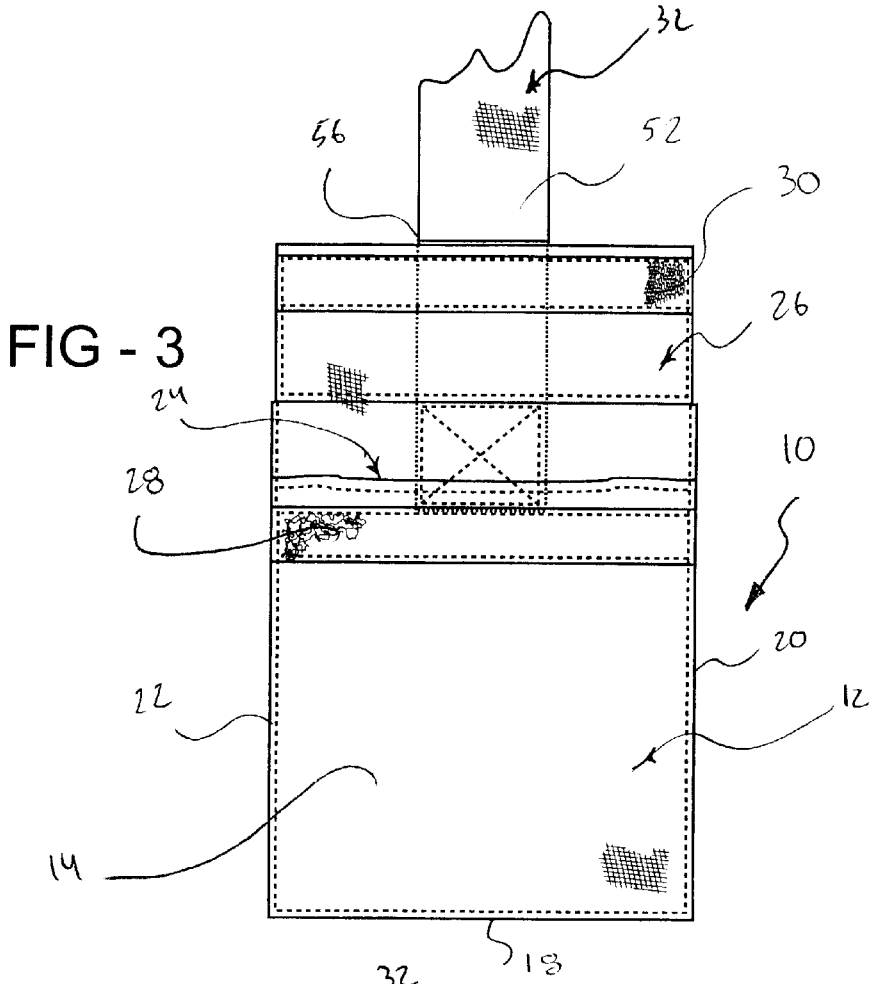
FIG. 3 is a front view of the pocket portion with an opened flap portion.
Figure 4:
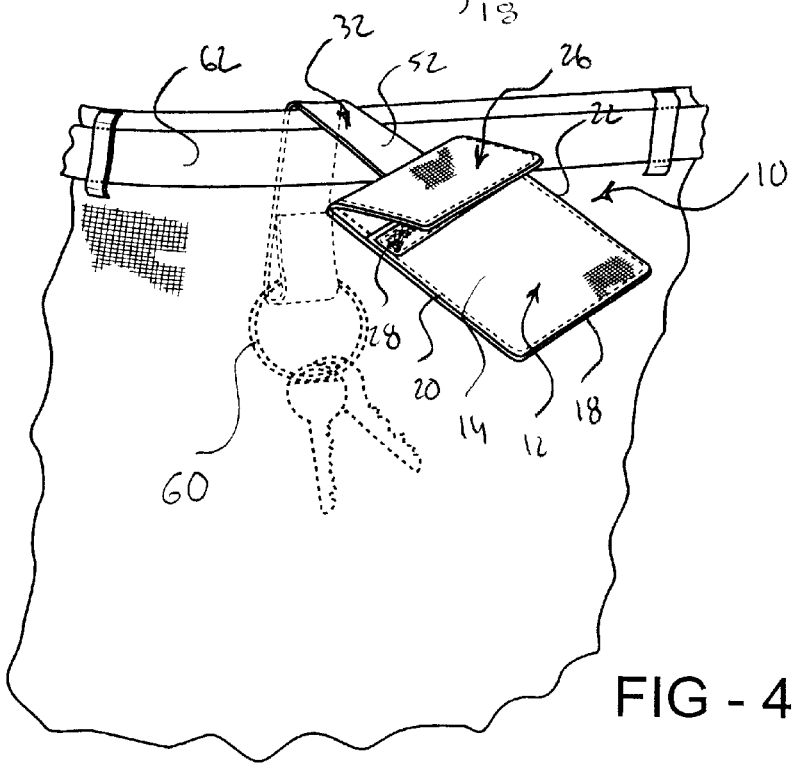
FIG. 4 is a perspective view of the tethered wallet attached to the key-ring wherein the wallet located outside the waistband.

Referring to the FIGS. 1 through 6, wherein like numerals indicate like or corresponding part throughout the several views, a tethered wallet is generally shown at 10.

The wallet 10 comprises a pocket portion, generally indicated at 12, defining a pocket having a front panel 14, a rear panel 16, a bottom 18, side edges 20, 22 and an open top 24. The wallet 10 further includes a flap portion, generally indicated at 26, that extends from the rear panel 16 for folding over the open top 24 to engage the front panel 14. The wallet 10 includes a plurality of fasteners 28 and 30 disposed on the front panel 14 and the flap portion 26 for engaging the flap portion 26 with the front panel 14. The wallet 10 includes a tether, generally indicated at 32, extending from the rear panel 16 of the pocket portion 12 and including a plurality of fasteners 34, 36, 38 spaced from one another for folding the tether 32 upon itself to define a loop of various different sizes.

The pocket portion 12 of the wallet 10 comprises the front panel 14 integrally connected to the rear panel 16 wherein the panels 14, 16 are folded upon one another along the bottom 18 of the panels 14, 16. The front 14 and rear 16 panels of the wallet 10 are sandwiched and secured together along the edges 20, 22 thereof. The panels 14, 16 are sewed with one another along the edges 20, 22 or may be connected by adhesive, staples, etc. The open top 24 of the pocket portion 12 opens into a space between the panels 14, 16 and is used to carry small and valuable items such as credit cards, keys, items of personal identification, money, small precious things, or the like (not shown).

The fasteners comprise first 28 and second 30 fastening strips. The front panel 14 includes the first fastening strip 28 attached to outer portion of the front panel 14 and adjacent the open top 24 of the pocket portion 12. The first fastening strip 28 comprises a male material, such as VELCRO hooks to engage VELCRO loops.

The rear panel 16 of the pocket portion 12 is integral with and extends above the front panel 14 to define the flap portion 26. The flap portion 26 includes the second fastening strip 30 attached to the inner portion of the flap portion 26. The second fastening strip 30 comprises a female material, such as VELCRO loops to engage VELCRO hooks of the first fastening strip 28 for engaging the first fastening strip 28 adjacent the open top 24 of the pocket portion 12.

As appreciated by those skilled in the art, various materials can be used to comprise the fastening strip 28 wherein combination of male and female materials is required to provide for engaging both materials therewith. Also, the front 14 and rear 16 panels of the pocket portion 12 may comprise different materials, such as woven ballistic nylon, fabric, sheet materials, and the like, that are durable, washable, light, moisture resistant, and flexible. In addition, the wallet 10 may comprise real and artificial leather.

The tether 32 comprises a strap having front 52 and rear 54 sides extending between first 56 and second 58 ends of the strap 32. The first end 56 of the strap is secured to the rear panel 16, as by sewing. The strap 32 includes at least two fasteners 34, 36 spaced from one another on one side of the strap 32. One of the fasteners comprises the first fastener 34 attached to one 58 of the ends of the strap 32. The other of the fasteners comprises the second fastener 36 attached to the other end 56 of the strap 32. Furthermore, the strap 32 includes a third fastener 38 disposed between the first 34 and second 36 fasteners.

The first fastener 34 comprises one of the male or female material, such as VELCRO hooks or loops, and the second 36 and third 38 fasteners comprise the other of the male or female material, respectively, for securing the materials therebetween whereby the first fastener 34 may be connected to the second fastener 36 to form a large loop or the first fastener 34 may be connected to the third fastener 38 to form a small loop. The small loop is used to engage the key-ring 60 while, as shown in FIGS. 4 through 7, the large loop is used to engage the belt 62 of a user, as shown in FIG. 8. Similar to the pocket portion 12, the tether 32 may comprise different materials, such as woven ballistic nylon, fabric, sheet materials, and the like, that are durable, washable, light, moisture resistant, and flexible. In addition, the wallet 10 may comprise real and artificial leather.

The wallet 10 can be conveniently attached to the key-ring 60, if an owner of the wallet does not have pockets in his/her wardrobe or simply wishes to use the key-ring 60 with the wallet 10, as shown in FIG. 5. The wallet may also be loop strapped several times around the belt 62 for extra protection, with both the wallet and key-ring 60 located inside or outside of the waistband. In addition, the large loop of the strap may engage the belt of the user.

Obviously, many modifications and variations of the present invention are possible in light of the above teachings. The invention may be practiced otherwise than as specifically described within the scope of the appended claims. These antecedent recitations should be interpreted to cover any combination in which the incentive novelty exercises its utility. In addition, the reference numerals in the claims are merely for convenience and are not to be read in any way as limiting.

What is claimed is:

1. A wallet (10) comprising:

a pocket portion (12) defining a pocket having a front panel (14) and a rear panel (16) integrally connected to said front panel (14) and folded upon one another along a bottom (18) of said front panel (14) and said rear panel (16), said front panel (14) and said rear panel (16) of said pocket portion (12) having edges wherein (20, 22) with said front panel (14) and said rear panel (16) being secured together along said edges (20, 22) thereof to expose an open top (24), a flap portion (26) integral with and extending from said rear panel (16) for folding over said open top (24) to define a top fold over said open top (24) and to engage said front panel (14), a first fastening strip (28) of a first fastening material attached to outer portion of said front panel (14) adjacent said open top (24), a second fastening strip (30) of a second fastening material attached to the inner portion of said flap portion (26) for engaging said first fastening strip (28), a strap (32) having front (52) and rear (54) sides extending between first (56) and second (58) ends and being separate from said rear panel (16) and said flap portion (26) with first end (56) secured to said rear panel (16) below said open top (24), and below said top fold to extend upwardly from said top fold, a plurality of fasteners (34), (36), (38) spaced from one another along said strap (32) for folding said strap (32) upon itself to define a loop of various different sizes, a first fastener (34) attached to one of said ends (56, 58) of said strap (32), wherein said first fastener (34) comprises one of a male and female material of hooks and loops respectively, a second fastener (36) attached to the other end (56, 58) of said strap (32), a third fastener (38) disposed between said first (34) and said second (36) fasteners on said strap (32), said second (36) and third (38) fasteners comprising the other of said male or female hooks and loops for securing either of said second (36) and third (38) fasteners to said first fastener (34) whereby said first fastener (34) connects with said second fastener (36) to form a large loop and said first fastener (34) connects with said third fastener (38) to form a small loop.

* * * * *